US010463558B2

(12) United States Patent
Skursky

(10) Patent No.: US 10,463,558 B2
(45) Date of Patent: Nov. 5, 2019

(54) SPINE ASSISTING TABLE

(71) Applicant: Elizabeth A Skursky, Largo, FL (US)

(72) Inventor: Elizabeth A Skursky, Largo, FL (US)

( * ) Notice: Subject to any disclaimer, the term of this patent is extended or adjusted under 35 U.S.C. 154(b) by 0 days.

(21) Appl. No.: 16/163,267

(22) Filed: Oct. 17, 2018

(65) Prior Publication Data

US 2019/0125605 A1 May 2, 2019

Related U.S. Application Data

(60) Provisional application No. 62/577,925, filed on Oct. 27, 2018.

(51) Int. Cl.

| | |
|---|---|
| ***A47C 9/00*** | (2006.01) |
| ***A61G 15/12*** | (2006.01) |
| ***A61G 15/00*** | (2006.01) |
| ***A61G 13/12*** | (2006.01) |
| ***A47C 16/00*** | (2006.01) |
| ***A61G 13/00*** | (2006.01) |

(52) U.S. Cl.

CPC ..... *A61G 15/125* (2013.01); *A47C 9/005* (2013.01); *A47C 16/00* (2013.01); *A61G 13/009* (2013.01); *A61G 13/121* (2013.01); *A61G 13/122* (2013.01); *A61G 13/1245* (2013.01); *A61G 15/007* (2013.01); *A61G 2200/325* (2013.01); *A61G 2200/38* (2013.01)

(58) Field of Classification Search

CPC .. A61G 15/007; A61G 15/125; A61G 13/009; A61G 13/121; A61G 13/122; A61G 13/1245; A61G 7/015; A61G 13/08; A47C 9/005; A47C 16/00; A47C 1/143; A47C 20/026; A47C 9/002; A61H 1/0222; A61H 1/0229; A61H 1/0292; A61H 1/0218; A61H 1/005; A61H 1/001; A61H 1/00; A61H 2201/0134; A61H 2201/1623; A61H 2201/1626; A61H 2201/1609; A61H 2201/1611; A61H 2205/04; A63B 69/10

See application file for complete search history.

(56) References Cited

U.S. PATENT DOCUMENTS

| | | | | |
|---|---|---|---|---|
| 4,650,249 | A | 3/1987 | Serber | |
| 4,653,751 | A * | 3/1987 | Green | A63B 21/4029 482/104 |
| 5,295,728 | A | 3/1994 | Schaevitz | |
| 5,401,078 | A | 3/1995 | Riach | |
| 5,472,401 | A | 12/1995 | Rouillard et al. | |
| 6,698,831 | B2 | 3/2004 | Lloyd | |
| D555,249 | S | 11/2007 | Roleder et al. | |
| 9,180,329 | B2 * | 11/2015 | Doane | A63B 21/00047 |
| 9,474,668 | B1 | 10/2016 | Skursky | |
| 2010/0037397 | A1 * | 2/2010 | Wood | A61G 7/015 5/657 |

* cited by examiner

*Primary Examiner* — Kari K Rodriquez
*Assistant Examiner* — Camtu T Nguyen
(74) *Attorney, Agent, or Firm* — Thomas Frost

(57) ABSTRACT

The invention relates to an adjustable table for use while laying in a prone position on a body section cushion and includes a knee cushion for leg support. A headrest is provided for securing the head while lying face down, along with a work platform. A detachable foot platform is also provided.

8 Claims, 7 Drawing Sheets

SPINE ASSISTING TABLE

FIELD OF THE INVENTION

The present invention relates to an adjustable table for relieving back stress while in a prone position.

BACKGROUND OF THE INVENTION

The general purpose of the present invention, which will be described subsequently in greater detail, is to provide a new and improved table device.

An individual having an injured cervical and/or lumbar back region needs to minimize the stress and strain on the lower back. Lying in a prone position on one's stomach minimizes stress and strain on the lower back, and also reduces strain on the neck. Such an individual cannot work at a desk without a great deal of discomfort.

The current invention provides a way for an individual to work at a work platform or desk while in a prone position.

SUMMARY OF THE INVENTION

The general purpose of the present invention, which will be described subsequently in greater detail, is to provide a new and improved table for lying in a prone position.

The device comprises a base support frame which is attached to a padded knee cushion and having means to adjust the angle between the knee cushion and the support frame. A detachable foot platform is connected to the support frame at one end. A slidably positionable padded body cushion is provided, along with a detachable headrest, elbow cushion and work platform.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
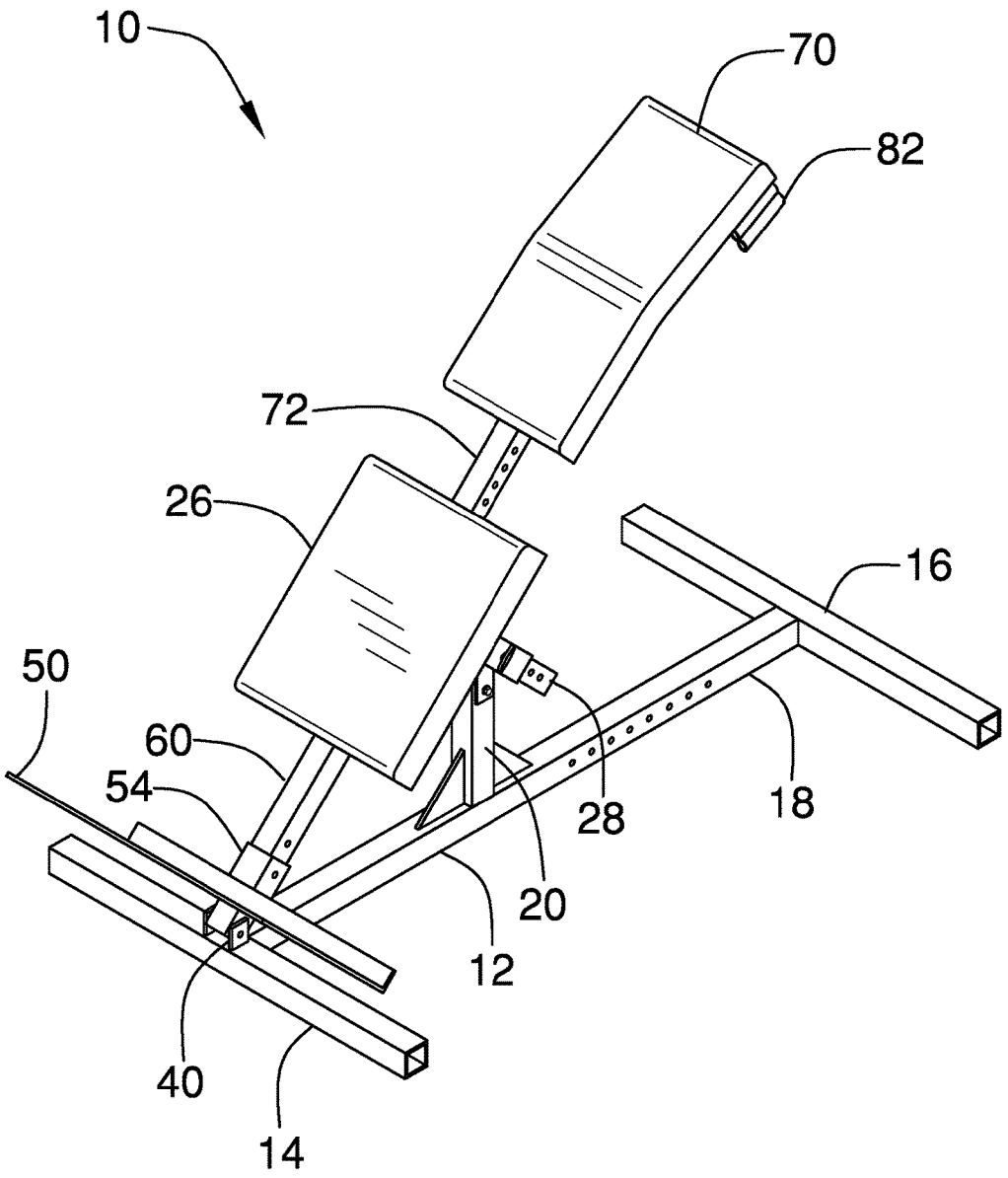
FIG. 1 is a frontal view of the present invention with a body cushion in a raised position.
Figure 2:
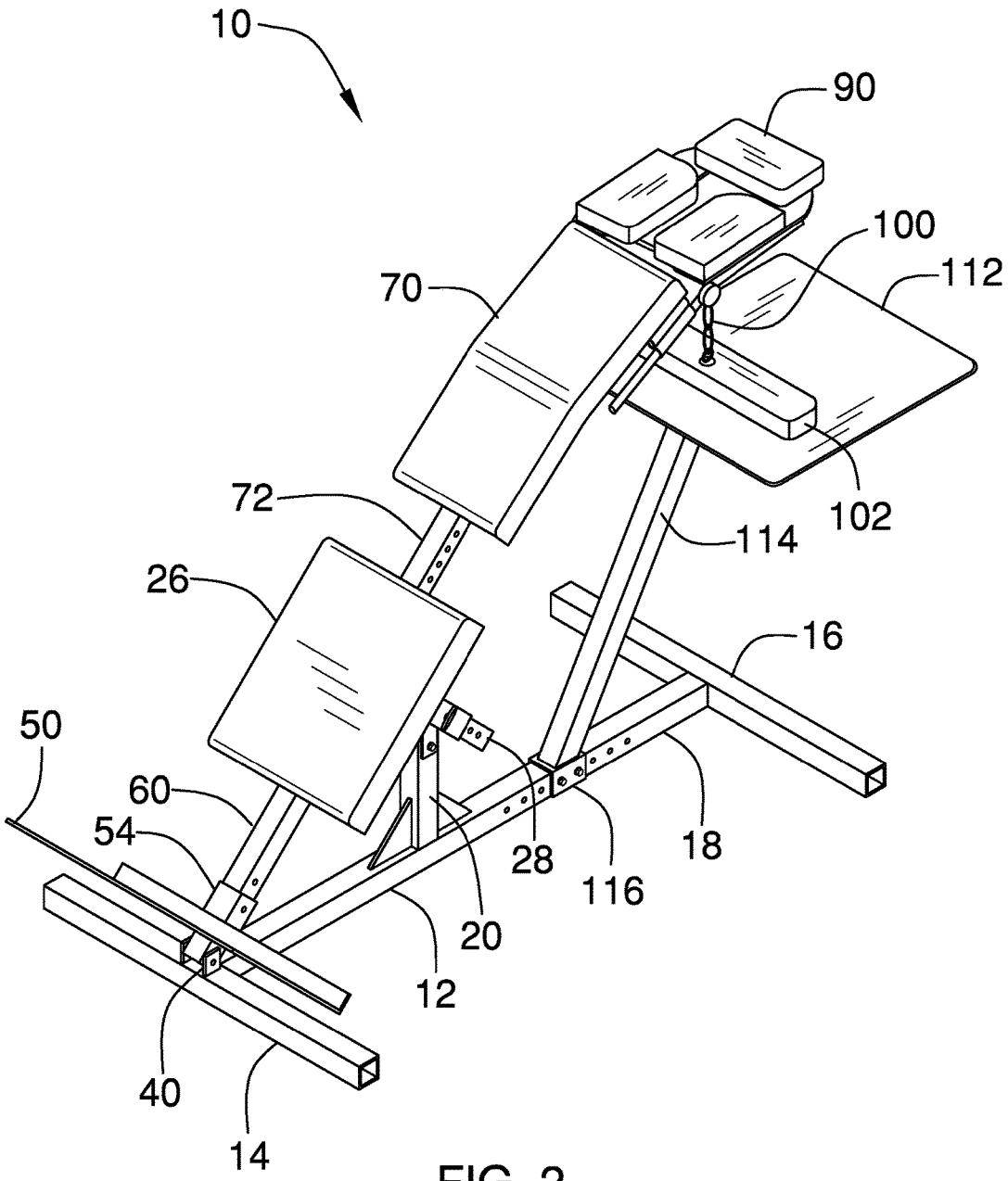
FIG. 2 is a frontal perspective view of the present invention including headrest, elbow cushion and work platform.
Figure 3:
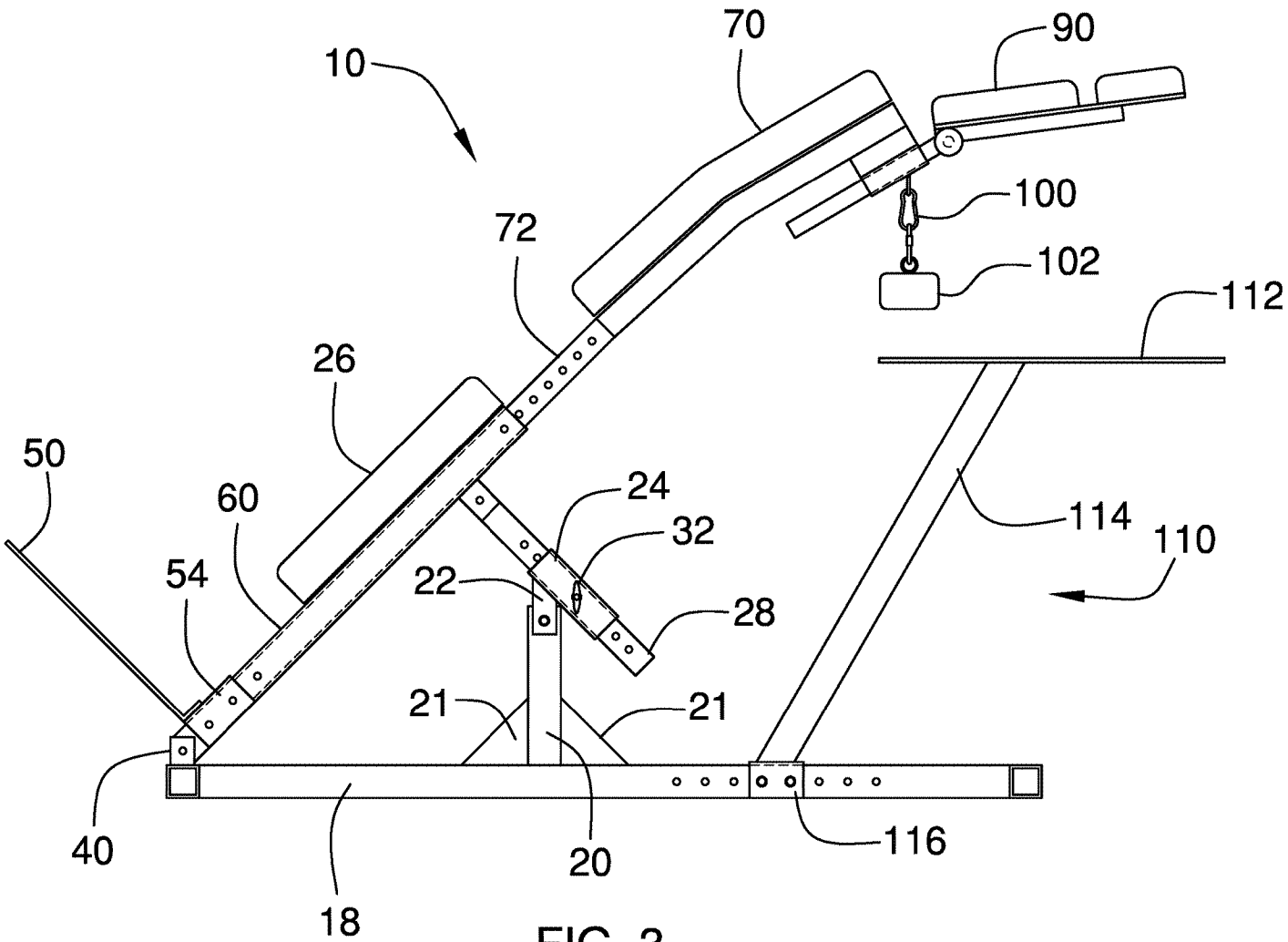
FIG. 3 is a side elevational view of the present invention.
Figure 4:
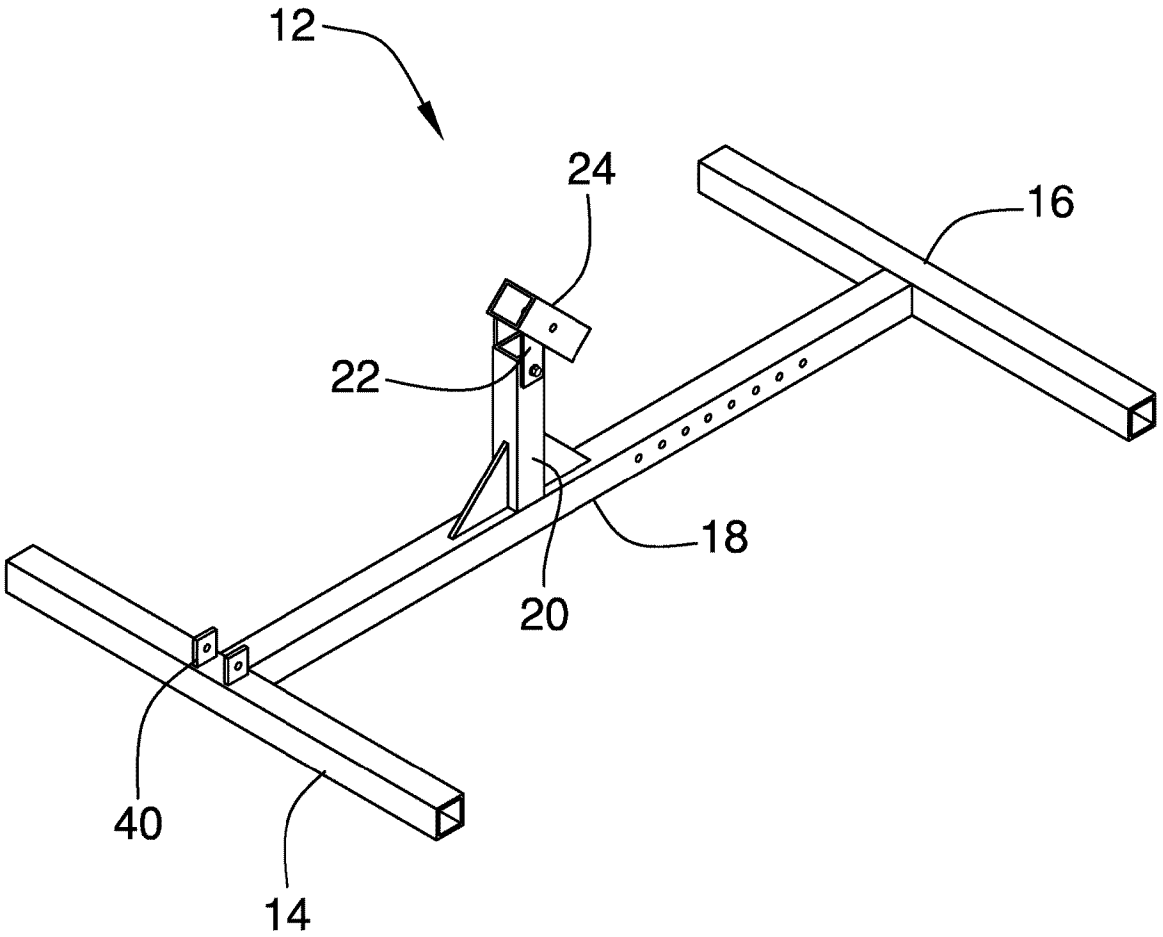
FIG. 4 is a top plan view of a base frame.
Figure 5:
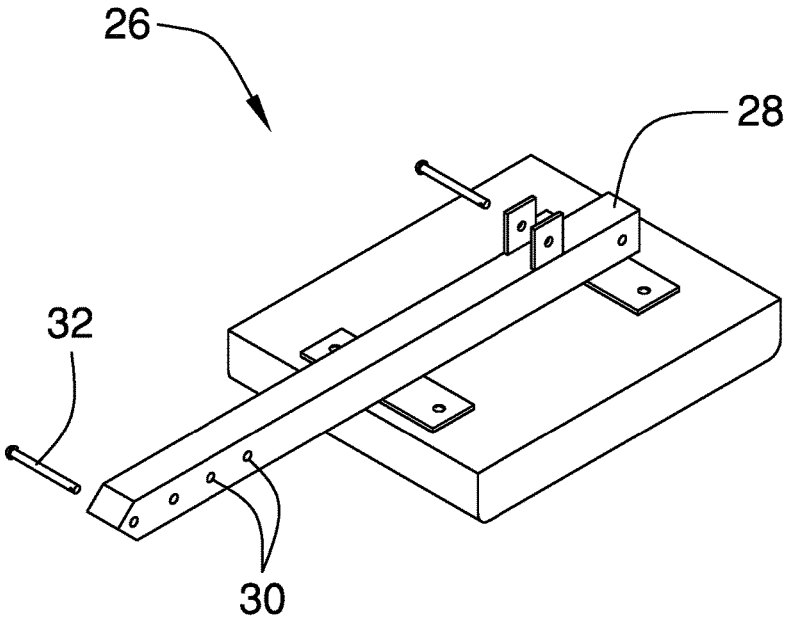
FIG. 5 is a bottom view of a knee pad affixed to a tubular post.
Figure 6:
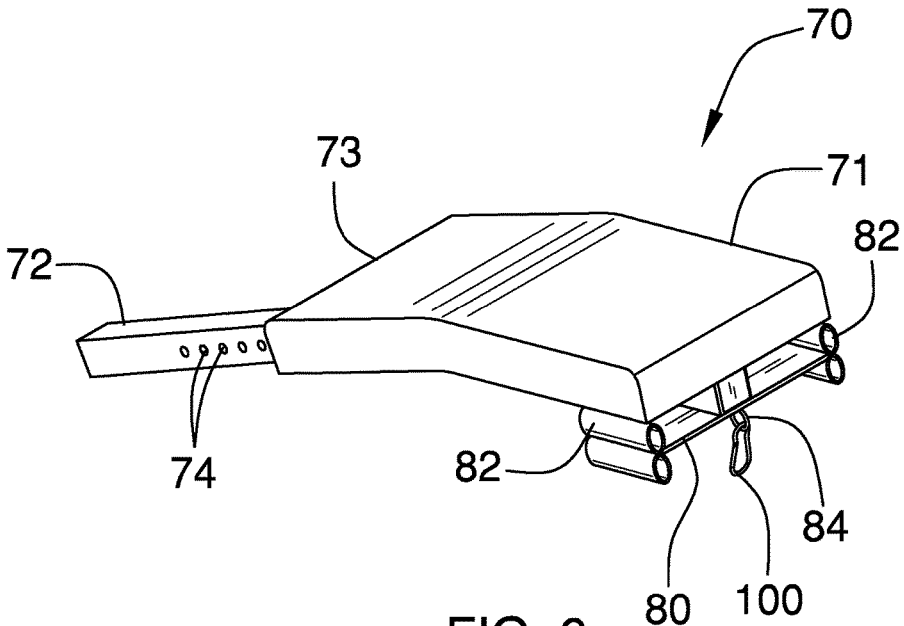
FIG. 6 is a top view of a body section cushion affixed to a longitudinal rail.
Figure 7:
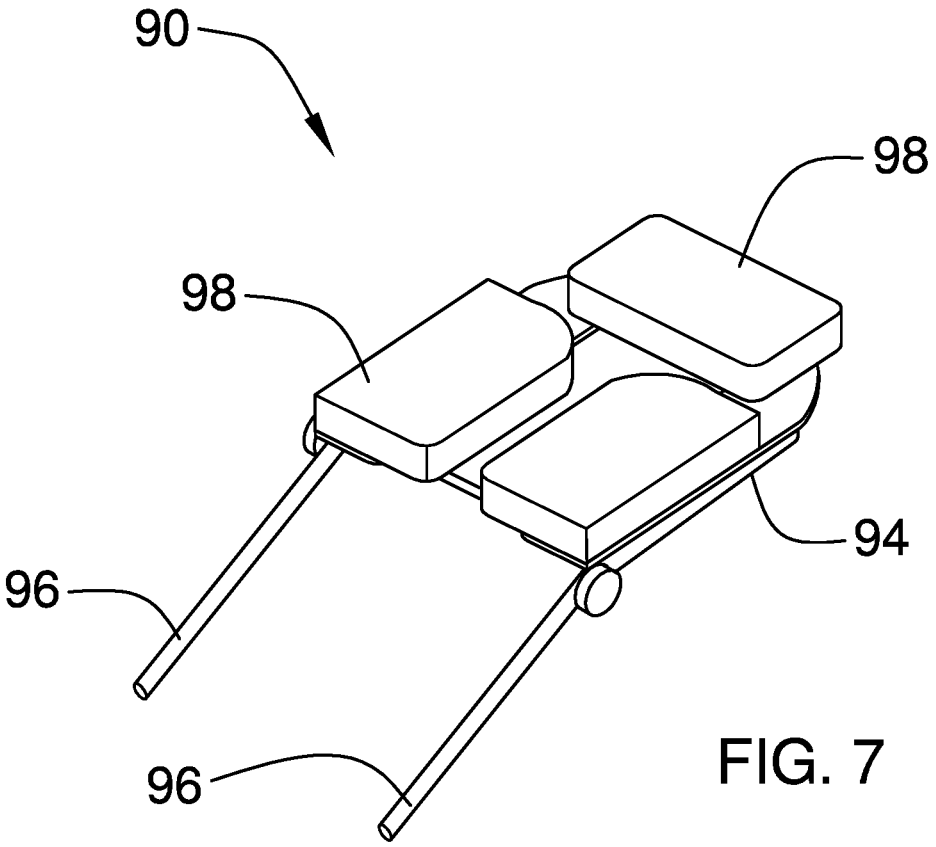
FIG. 7 illustrates a perspective view of a headrest.
Figure 8:
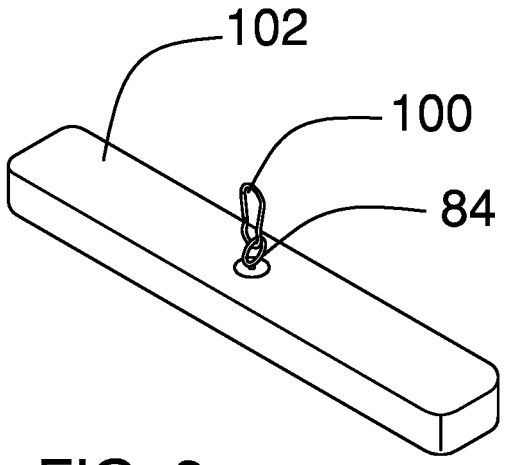
FIG. 8 illustrates a perspective view of an arm rest.
Figure 9:
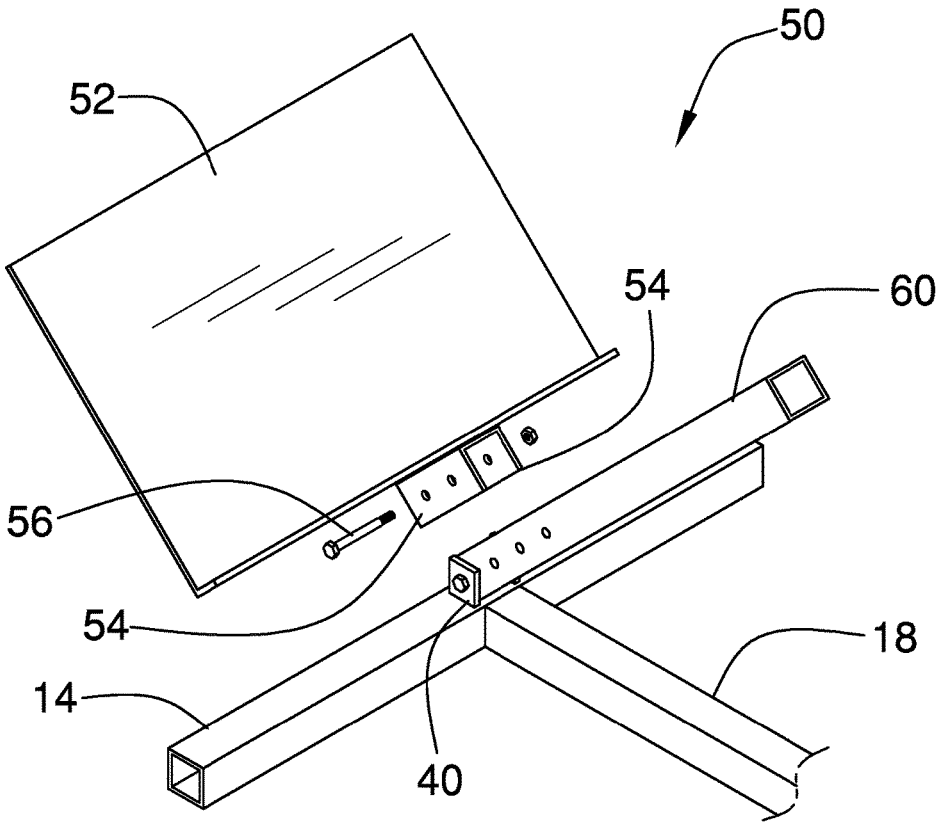
FIG. 9 is an exploded view of the foot platform detached from a base frame.
Figure 10:
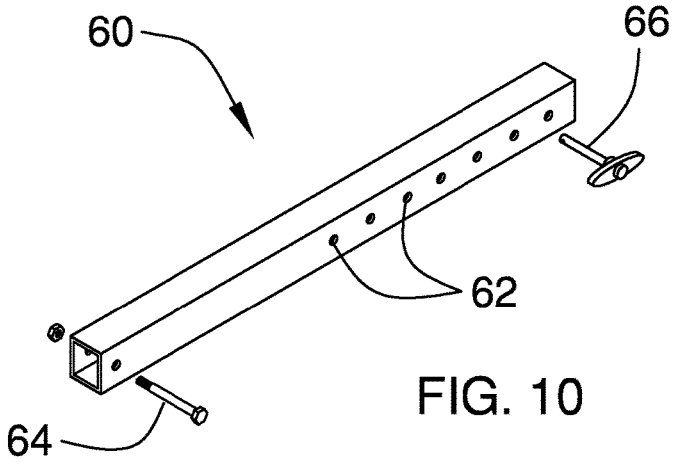
FIG. 10 is a top plan view of a vertical support post attached to the base frame in FIG. 9.

Referring generally to the FIGS. 1-9, the present invention 10 is illustrated. A generally rectangular base support frame 12 has a first end rail 14 (foot end) and a second end rail 16 (head end). A cross brace 18 has a first end and a second end affixed to inner surfaces of the end rails 14, 16, and the cross brace is aligned perpendicular to the end rails

14, 16. The support frame 12 is preferably composed of rectangular tubing. A support post member 20 extends vertically from the cross brace 18 at a first end, and the post member 20 has a bracket 22 with an aperture formed therethrough at a second end. A tube member 24 is pivotally attached to the bracket 22. The post member 20 has a pair of fins 21 integrally formed on opposed sides to provide stability.

A padded knee cushion 26 having a tubular post member 28 attached to a bottom surface of the knee cushion 26, and the post member 28 is slidably engageable and selectively adjustable with the tube member 24. The post member 28 has apertures 30 formed through side walls, and the apertures 30 are dimensioned to be operatively engaged with a spring-loaded pin 32. The post member 28 is telescoped and locked in position. Thus, the post member 28 is vertically adjustable to reposition the knee cushion 26 relative to the base frame 12 and create various angles between the knee cushion 26 and the base frame 12.

The support frame 12 further has a bracket 40 comprised of a first wall and a second wall defined on an upper surface of the first end rail 14. The bracket 40 has apertures defined therethrough. A vertical support post 60 comprised of rectangular tubing, having apertures 62 formed through side walls, is pivotally connected to the bracket 40 of the support frame 12 via a pin 64. A foot platform 50 comprised of a panel 52 and a bracket 54 with a connecting pin 56 is detachably connected by engaging the connecting pin 56 though the apertures of the vertical support post 60. It can be readily seen that the positioning of the platform 50 can be adjusted according to the height of a user by locating the pin 56 through a different aperture of the vertical support post 60.

A padded body section cushion 70 is mounted on an upper surface of a longitudinal rail 72. The rail 72 is slidably positionable and telescoped into the vertical support post 60, and the rail 72 has a series of apertures 74 to lined up with the apertures 62 of the vertical support post 60. A spring-loaded pin 66 secures the vertical support post 60 to the rail 72 by inserting through the complimentary apertures. The body section cushion 70 can thus be adjusted relative to the knee pad 26.

The body section cushion 70 is generally arcuate in shape having a horizontal first portion 71 and an inclined second portion 73. The first portion 71 is positioned principally for the upper body torso and the second portion 73 is positioned principally for the lower body torso.

A plank 80, having an upper and a lower surface, has a pair of channel members 82 integrally formed on opposed sides of the plank 80. The upper surface of the plank 80 is mounted to a bottom surface of the distal most part of the rail 72. A circular closed ring 84 is attached to the bottom surface of the plank 80.

A headrest 90 comprised of a headrest frame support 94 with a pair of dowels 96 and a plurality of headrest cushion sections 98 is slidably connected to the channel members 82. An individual may lay face down on the headrest cushion sections 98 and not have to turn their neck or head to breathe.

A chain 100 having is connected at a first end to the circular ring 84. A padded elbow cushion 102 is connected at a second end of the chain 100. The length of the chain 100 can be adjusted to reposition the elbow cushion 102 relative to the body section cushion 70. The elbow cushion 102 supports the user's arms to reduce strain and stress on the user's shoulders and cervical spine.

A work platform 110 is positioned below the body section cushion 70. The work platform is comprised of a work surface panel 112 mounted to an upwardly depending adjustable angled tubular rail 114 and a bracket 116 connected to the cross brace 18 of the support frame 12. The brace 116 can be disengaged and repositioned horizontally along the cross brace 18. The work platform 110 is positioned in front of the elbow cushion 102 and is utilized for the placement of laptop computers and the like. The user can lie in a prone position face down and access portable devices with their hands, alleviating the need for a table and desk.

The work platform 110 allows the user to lay face down which may relieve or reduce lower back pain, which is lumbar spine stress from sitting or standing. The headrest 90 supports the head, which may reduce or remove neck pain caused by cervical spine stress. The detachable and adjustable foot platform 50 allows the user to effectively position the body and head for work at the work platform 110. The body section cushion 70 is narrowed to maximize the ability of the arms and hands to utilize the surface of the panel 112.

To start, the user steps up approximately four inches onto the foot platform 50 and presses his or her legs into the knee cushion 26. The foot platform 70 is adjusted to position the body, hands and feet. The user then mounts the table 10 and lays in a prone position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

I claim:

1. A spine assisting table, comprising in combination:

a support frame having a first end rail, a second end rail and a cross brace aligned perpendicular to the end rails;

a support post member extending vertically from the cross brace at a first end and having a first bracket with an aperture defined therethrough at a second end;

a tube member pivotally attached to the first bracket;

a padded knee cushion having a tubular post member, whereby the tubular post member is slidably engageable with the tube member;

a second bracket defined on the first end rail of the support frame;

a vertical support post having apertures defined therethrough pivotally connected via a pin to the second bracket defined on the first end rail;

a padded body section cushion mounted on an upper surface of a longitudinal rail having apertures defined therethrough; and whereby the longitudinal rail is horizontally adjustable and telescoping into the vertical support post utilizing a spring-loaded pin to selectively adjust the position of the padded body section cushion.

2. The table as set forth in claim 1, further comprising a foot platform having a panel and a third bracket, whereby the third bracket is detachably connectable with the vertical support post.

3. The table as set forth in claim 2, further comprising a plank having a pair of opposed channels integrally formed on opposed sides of the plank, whereby the plank is affixed to the longitudinal rail.

4. The table as set forth in claim 3, further comprising a headrest support frame with a pair of dowels and a plurality of cushion sections slidably mountable to the opposed channels affixed to the plank.

5. The table as set forth in claim 1, further comprising a work platform having a work surface panel mounted to an upwardly depending tubular rail and a bracket, whereby the bracket is connected to the cross brae of the support frame.

6. The table as set forth in claim 3, further comprising a ring attached to a bottom surface of the plank, a chain connected at a first end to the ring, and an elbow cushion connected at a second end of the chain.

7. A spine assisting table, comprising in combination:

a support frame having a first end rail, a second end rail and a cross brace aligned perpendicular to the end rails;

a support post member with fins integrally formed on opposed sides extending vertically from the cross brace at a first end and having a first bracket with an aperture defined therethrough at a second end;

tube member pivotally attached to the first bracket defined at the second end of the support post member;

a padded knee cushion having a tubular post member, whereby the tubular post member is slidably engageable with the tube member;

a second bracket defined on the first end rail of the support frame;

a vertical support post having apertures defined therethrough pivotally connected via a pin to the second bracket defined on the first end rail;

a padded body section cushion mounted on an upper surface of a longitudinal rail having apertures defined therethrough, whereby the longitudinal rail is horizontally adjustable and telescoping into the vertical support post utilizing a spring-loaded pin to selectively adjust the position of the padded body section cushion; and a foot platform having a panel and a third bracket member, whereby the third bracket member of the foot platform is detachably connectable with the vertical support post.

8. The table as set forth in claim 7, whereby the padded body section cushion is generally arcuate in shape having a horizontal first portion and an inclined second portion.

* * * * *